US008726760B2

(12) United States Patent
Kim et al.

(10) Patent No.: US 8,726,760 B2
(45) Date of Patent: May 20, 2014

(54) ADJUSTABLE PENDANT AND ORGAN TYPE ACCELERATOR PEDAL DEVICE IN VEHICLE

(75) Inventors: Eunsik Kim, Daegu (KR); Yangrae Cho, Hwaseong-si (KR); Hojong Oh, Busan (KR)

(73) Assignees: Hyundai Motor Company, Seoul (KR); Donghee Industrial Co., Ltd., Ulsan Metropolitan (KR)

( * ) Notice: Subject to any disclaimer, the term of this patent is extended or adjusted under 35 U.S.C. 154(b) by 171 days.

(21) Appl. No.: 13/190,314

(22) Filed: Jul. 25, 2011

(65) Prior Publication Data

US 2012/0132028 A1 May 31, 2012

(30) Foreign Application Priority Data

Nov. 30, 2010 (KR) ..... 10-2010-0120733

(51) Int. Cl.
*G05G 1/44* (2008.04)

(52) U.S. Cl.
USPC ..... 74/512; 74/513; 74/514; 74/560

(58) Field of Classification Search
USPC ..... 74/512–514, 560; 296/75; 180/90.6
See application file for complete search history.

(56) References Cited

U.S. PATENT DOCUMENTS

| | | | | |
|---|---|---|---|---|
| 1,130,336 | A * | 3/1915 | Renkenberger | 384/276 |
| 5,964,125 | A | 10/1999 | Rixon et al. | |
| 6,189,852 | B1 * | 2/2001 | Hopley et al. | 248/430 |
| 6,609,438 | B1 * | 8/2003 | Bigham et al. | 74/560 |
| 6,962,094 | B2 * | 11/2005 | Porter et al. | 74/512 |
| 2005/0005728 | A1 * | 1/2005 | Kojima et al. | 74/560 |
| 2007/0295146 | A1 * | 12/2007 | Takai | 74/512 |
| 2009/0223319 | A1 * | 9/2009 | Choi | 74/512 |
| 2010/0090084 | A1 * | 4/2010 | Moriyama et al. | 248/430 |

FOREIGN PATENT DOCUMENTS

| | | | |
|---|---|---|---|
| EP | 1 217 492 | A2 | 6/2002 |
| EP | 1 571 064 | A1 | 9/2005 |
| JP | 2003-335146 | A | 11/2003 |
| KR | 10-1999-0059716 | A | 7/1999 |
| KR | 10-2000-0015532 | A | 3/2000 |
| KR | 10-0395738 | B1 | 8/2003 |
| KR | 10-0816002 | B1 | 3/2008 |
| KR | 10-0934994 | B1 | 12/2009 |

* cited by examiner

*Primary Examiner* — Alan B Waits
*Assistant Examiner* — Brian McGovern
(74) *Attorney, Agent, or Firm* — Morgan, Lewis & Bockius LLP

(57) ABSTRACT

An adjustable pendant and organ type accelerator pedal device can vary the position of a pedal assembly including a pedal pad forwards and backwards according to driver's will to thereby allow a driver to operate pedal pad in a convenient state, such that convenience is remarkably improved and merchantability is significantly improved by greatly decreasing a sense of fatigue due to operating pedal pad.

8 Claims, 12 Drawing Sheets

ADJUSTABLE PENDANT AND ORGAN TYPE ACCELERATOR PEDAL DEVICE IN VEHICLE

CROSS-REFERENCE TO RELATED APPLICATIONS

The present application claims priority to Korean Patent Application Number 10-2010-0120733 filed Nov. 30, 2010, the entire contents of which application is incorporated herein for all purposes by this reference.

BACKGROUND OF INVENTION

1. Field of Invention

The present invention relates to an adjustable pedant and organ type accelerator pedal device in a vehicle, and more particularly, to a technology associated with an adjustable pedant and organ type accelerator pedal device in a vehicle capable of varying forward and backward positions of an accelerator pedal according to a driver's body shape.

2. Description of Related Art

In general, an accelerator pedal provided in a vehicle is a device for adjusting the rpm of an engine by controlling the amount of intake of a gasoline engine and controlling the amount of fuel injection for a diesel engine.

The accelerator pedal includes a pendant accelerator pedal suspended and installed on a dash panel, an organ accelerator pedal installed on a floor panel, and a pendant and organ accelerator pedal in which a pedant type and an organ type are mixed with each other, according to a mounting structure.

Herein, the pendant and organ type accelerator pedal device includes a main housing 11 fixedly installed on a dash panel 1 below a driver's seat, a lower bracket 12 fixedly installed on a floor panel 2 below the driver's seat, a supporting bracket 13 installed to connect lower bracket 12 with main housing 11, a pedal arm 15 having an upper end portion rotatably coupled to main housing 11 with a hinge shaft 14, and a pedal pad 16 installed to have an upper end hinge coupled to a lower end portion of pedal arm 15 and a lower end hinge coupled to lower bracket 12, as shown in FIG. 1.

The pendant and organ type accelerator pedal device in the related art is configured to operate as pedal pad 16 and pedal arm 15 rotate forwards when a driver applies a pedaling power by stamping on pedal pad 16 and pedal arm 15 and pedal pad 16 rotate backwards to be restored when the driver removes the pedaling power from pedal pad 16.

However, after the pendant and organ type accelerator pedal device in the related art is installed once, the position thereof cannot be varied, and as a result, as the same convenience is not provided to all drivers having various body shape, some drivers feel large inconvenience.

That is, since the driver should move the driver's seat forwards and backwards according to the position of the accelerator pedal, the driver feels inconvenience.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Various aspects of the present invention provide for an adjustable pedant and organ type accelerator pedal device in a vehicle that satisfy desires of all drivers having various body shapes by varying forward and backward positions of a pedal pad according to a driver's body shape to thereby improve merchantability.

Various embodiments of the present invention provide an adjustable pendant and organ type accelerator pedal device in a vehicle, comprising a main housing fixedly installed on a dash panel below a driver's seat, a lower mounting bracket fixedly installed on a floor panel below the driver's seat, an electric motor fixedly installed in the main housing, and a pedal assembly installed to be connected to the main housing and the lower mounting bracket to move forwards and backwards with respect to the main housing and the lower mounting bracket by motive power of the electric motor.

A housing groove opened backwards and a guide hole cut in forward and backward directions while penetrating left and right side surfaces in a form to pass through the housing groove may be integrally formed in the main housing.

A bracket groove with a space opened backwards and upwards and movable forwards and backwards and a pair of guide grooves that elongate in forward and backward directions on both side surfaces of the bracket groove may be integrally formed in the lower mounting bracket.

The pedal assembly may include a movable housing installed to move forwards and backwards along the housing groove while being installed in a form to be inserted in the housing groove, a supporting bracket having an upper end portion integrally coupled to the movable housing and a lower end portion integrally provided with a lower bracket coupled to the lower mounting bracket to move in forward and backward directions along the bracket groove, a pedal arm having an upper end portion rotatably coupled to the movable housing with a hinge shaft, a pedal pad having an upper end hinge-coupled to the lower end portion of the pedal arm and a lower end hinge-coupled to the lower bracket, a lead screw installed in the main housing to move along forward and backward directions by motive power of the electric motor, and a movable pin installed to be integrally coupled with the lead screw by penetrating the guide hole and the movable housing, and installed to move forwards and backwards through the guide hole when the lead screw moves.

A bracket protrusion inserted into the bracket groove and moving forwards and backwards along the bracket groove may integrally protrude on the bottom of the lower bracket, a protrusion hole penetrating both side surfaces in left and right directions may be formed in the bracket protrusion, a bracket roller may be installed to penetrate the protrusion hole, and both ends of the bracket roller may be inserted into the guide grooves, respectively.

An adjustable pendant and organ type accelerator pedal device in a vehicle according to various embodiments of the present invention can vary the position of a pedal assembly including a pedal pad forwards and backwards according to driver's will so as to allow a driver to operate the pedal pad in a convenient state, such that convenience is remarkably improved and merchantability is significantly improved by greatly decreasing a sense of fatigue due to the operation of the pedal pad.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

The methods and apparatuses of the present invention have other features and advantages which will be apparent from or are set forth in more detail in the accompanying drawings, which are incorporated herein, and the following Detailed Description, which together serve to explain certain principles of the present invention.

BRIEF DESCRIPTION OF THE DRAWINGS

FIG. 10 is a side cross-sectional view, and FIG. 11 is a diagram viewed from the rear side with a cover member removed.

Figure 1:
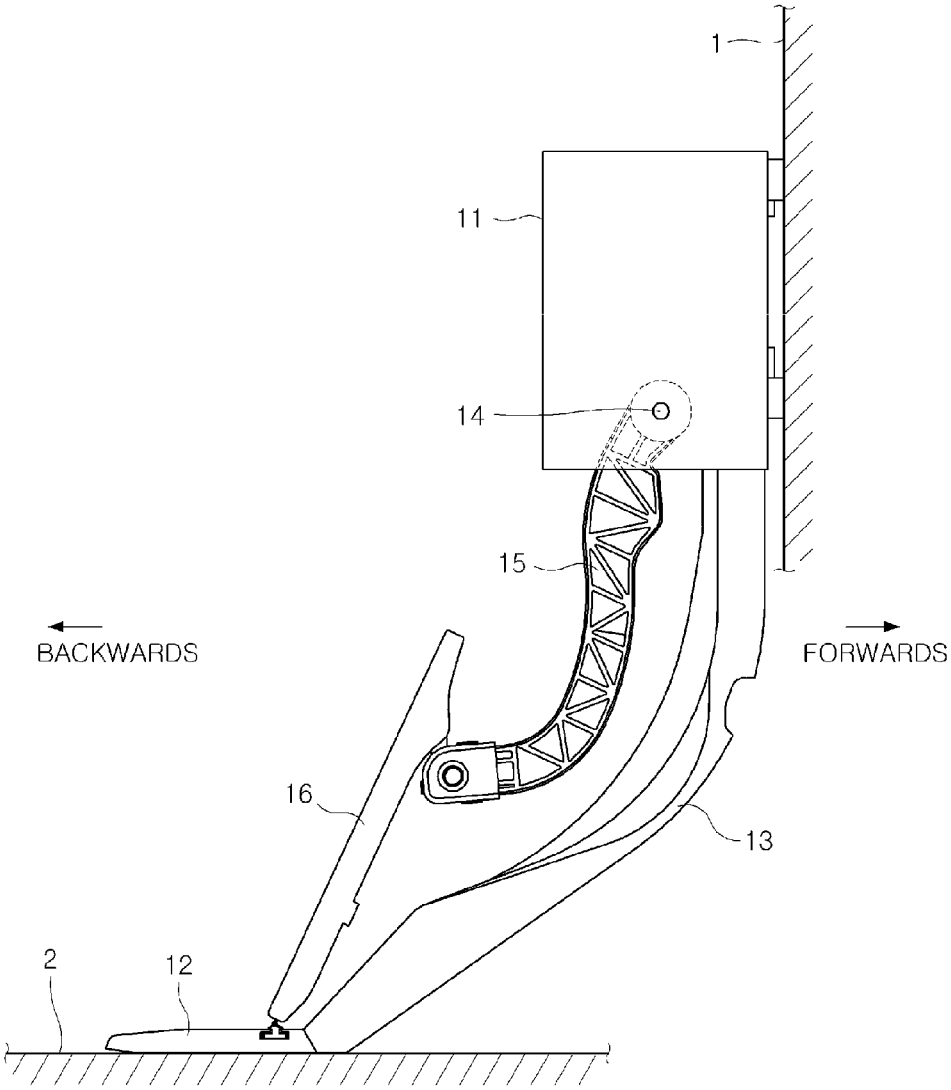
FIG. 1 is a schematic diagram of a pendant type adjustable organ type accelerator pedal device in the related art.
Figure 2:
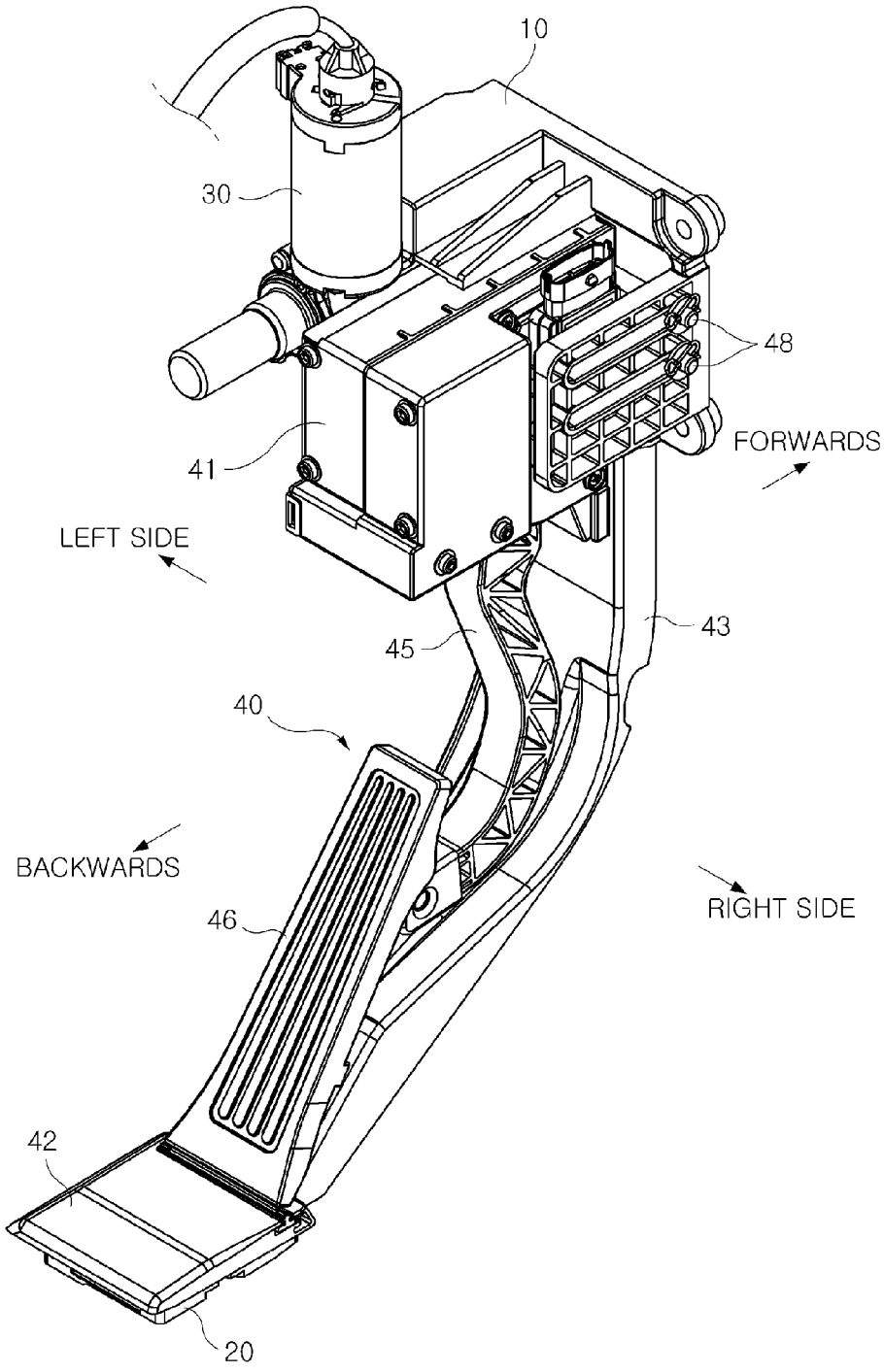
FIG. 2 is a perspective view of an exemplary pendant type adjustable organ type accelerator pedal device according to various embodiments of the present invention.
Figure 3:
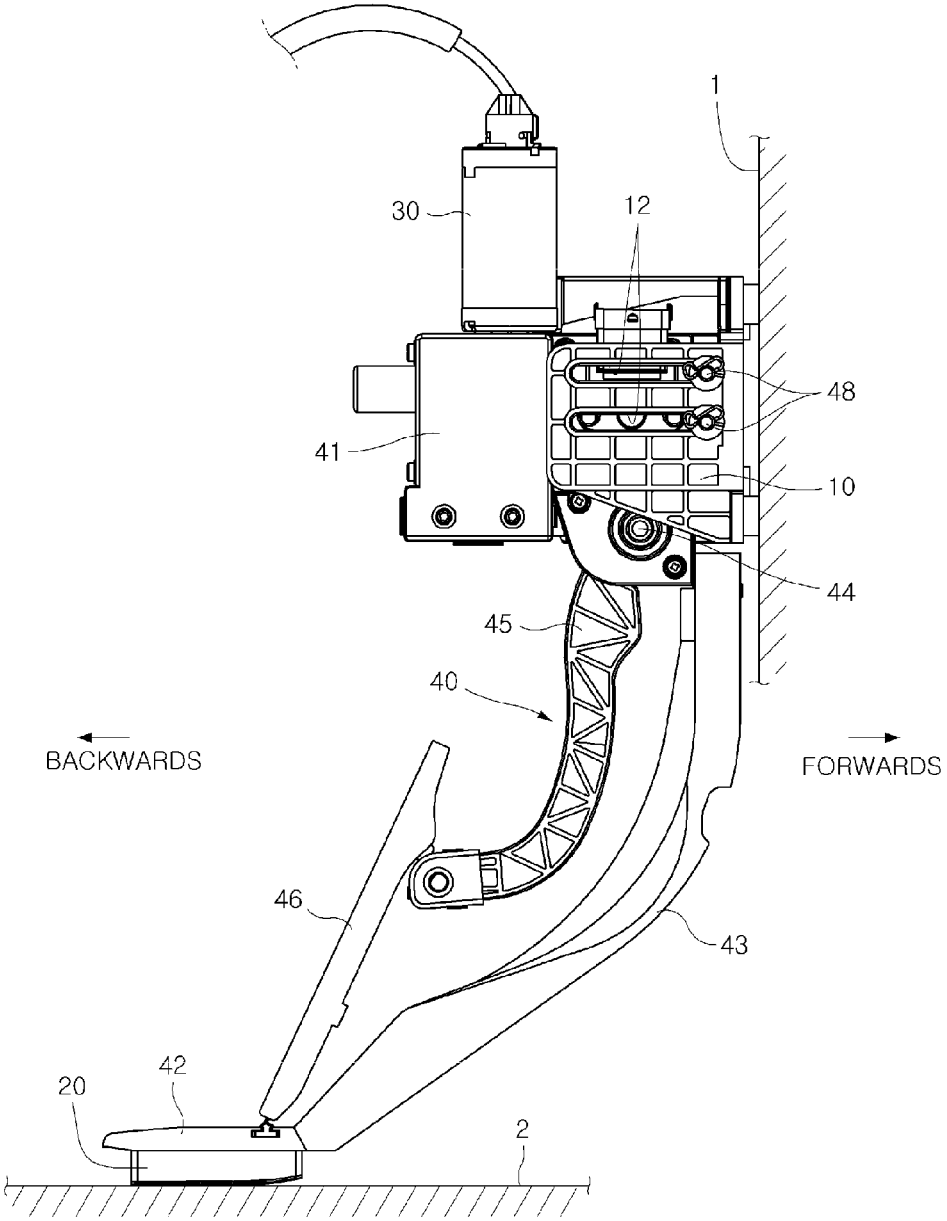
FIGS. 3 and 4 are a right side view and a left side view of FIG. 2.
Figure 4:
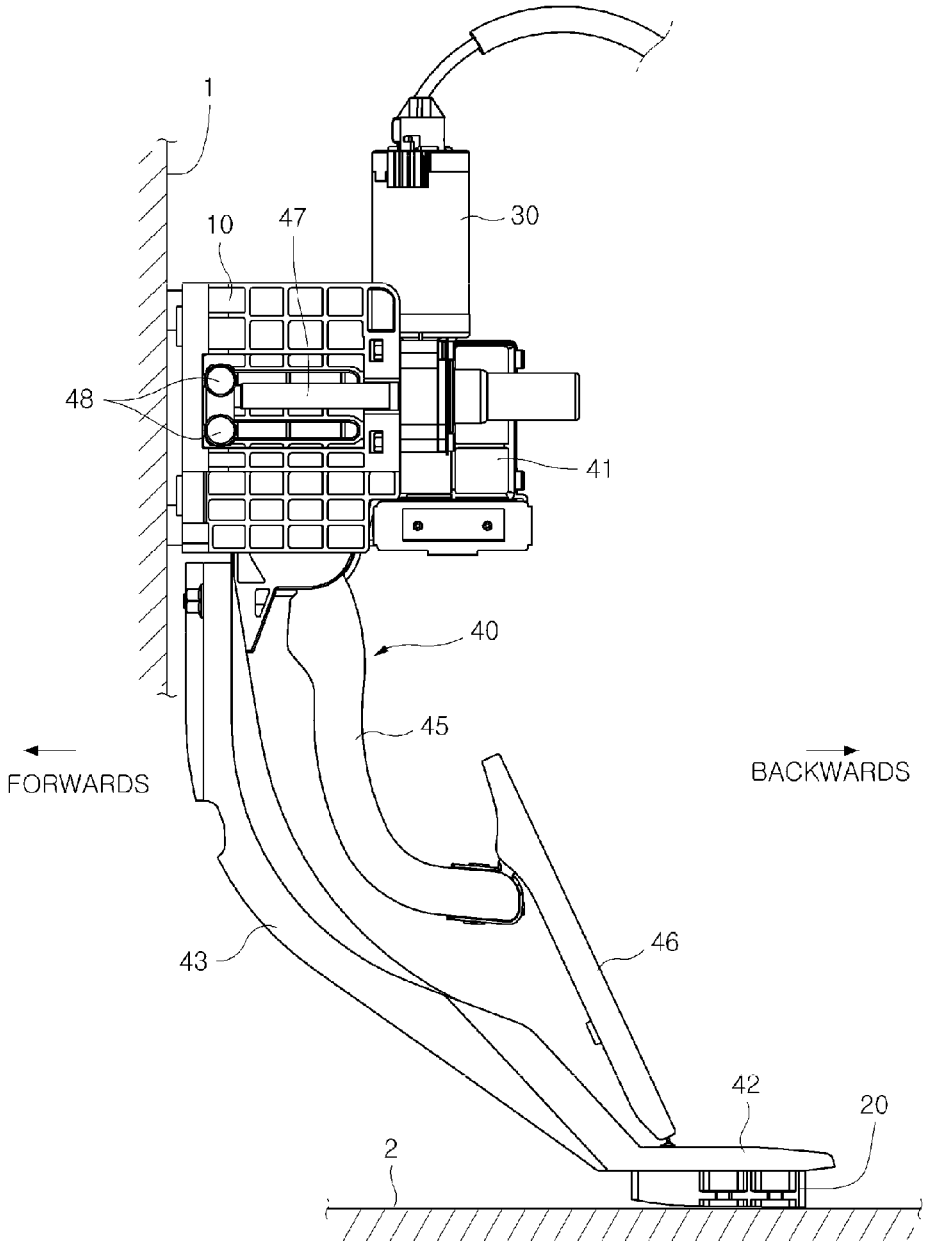
Figure 5:
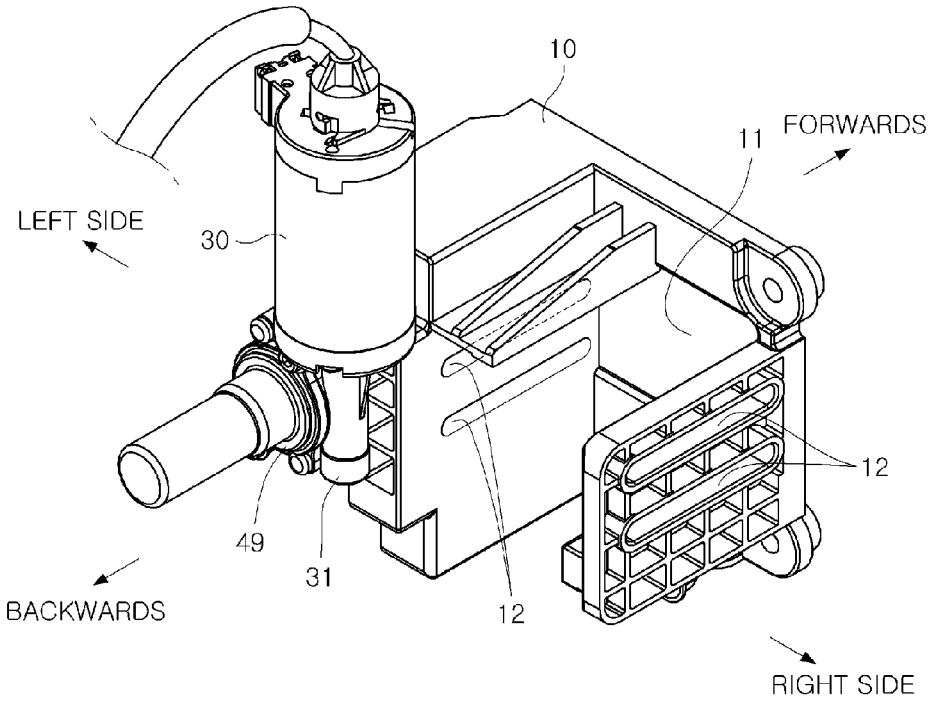
FIGS. 5 and 6 are diagrams showing an exemplary main housing and lower mounting bracket constituting the device according to the present invention.
Figure 6:
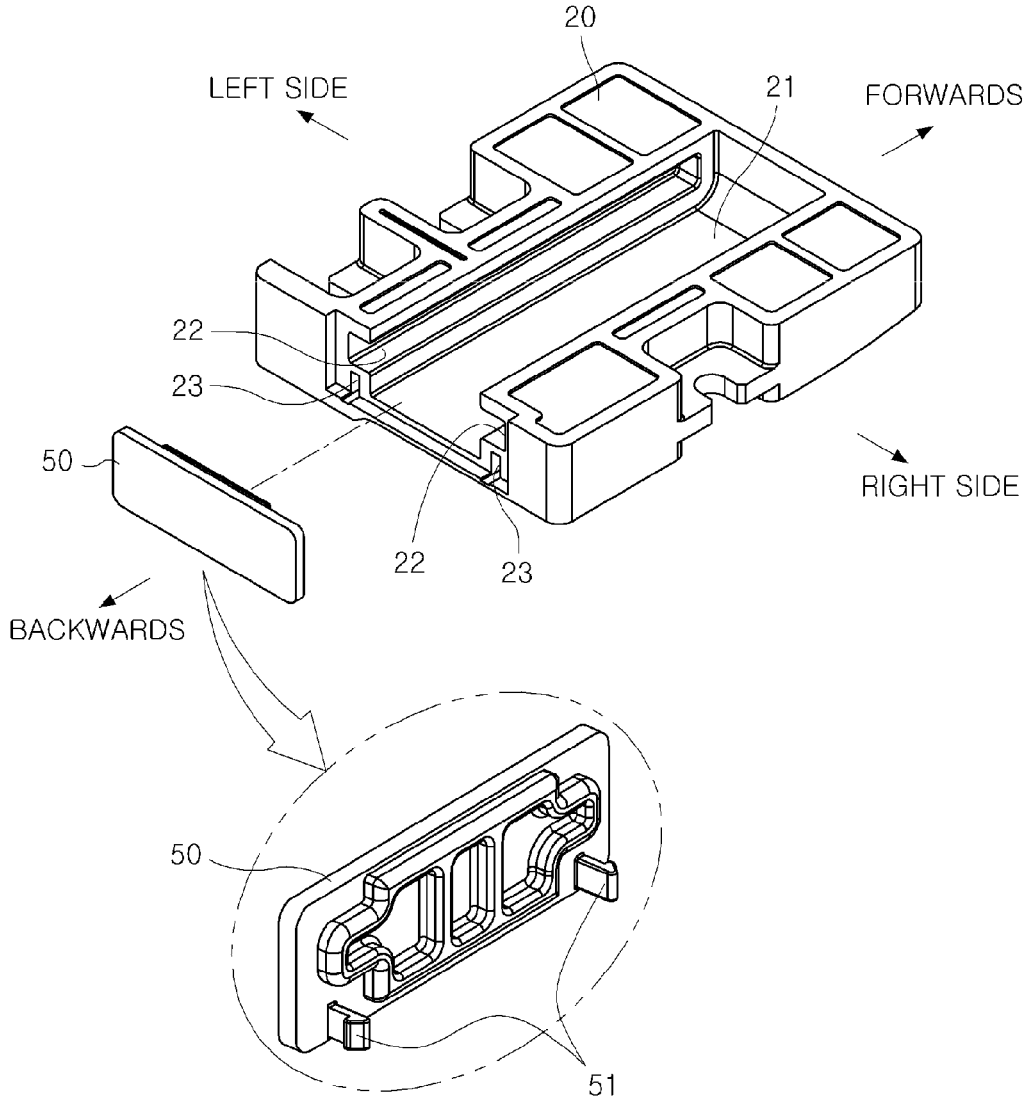
Figure 7:
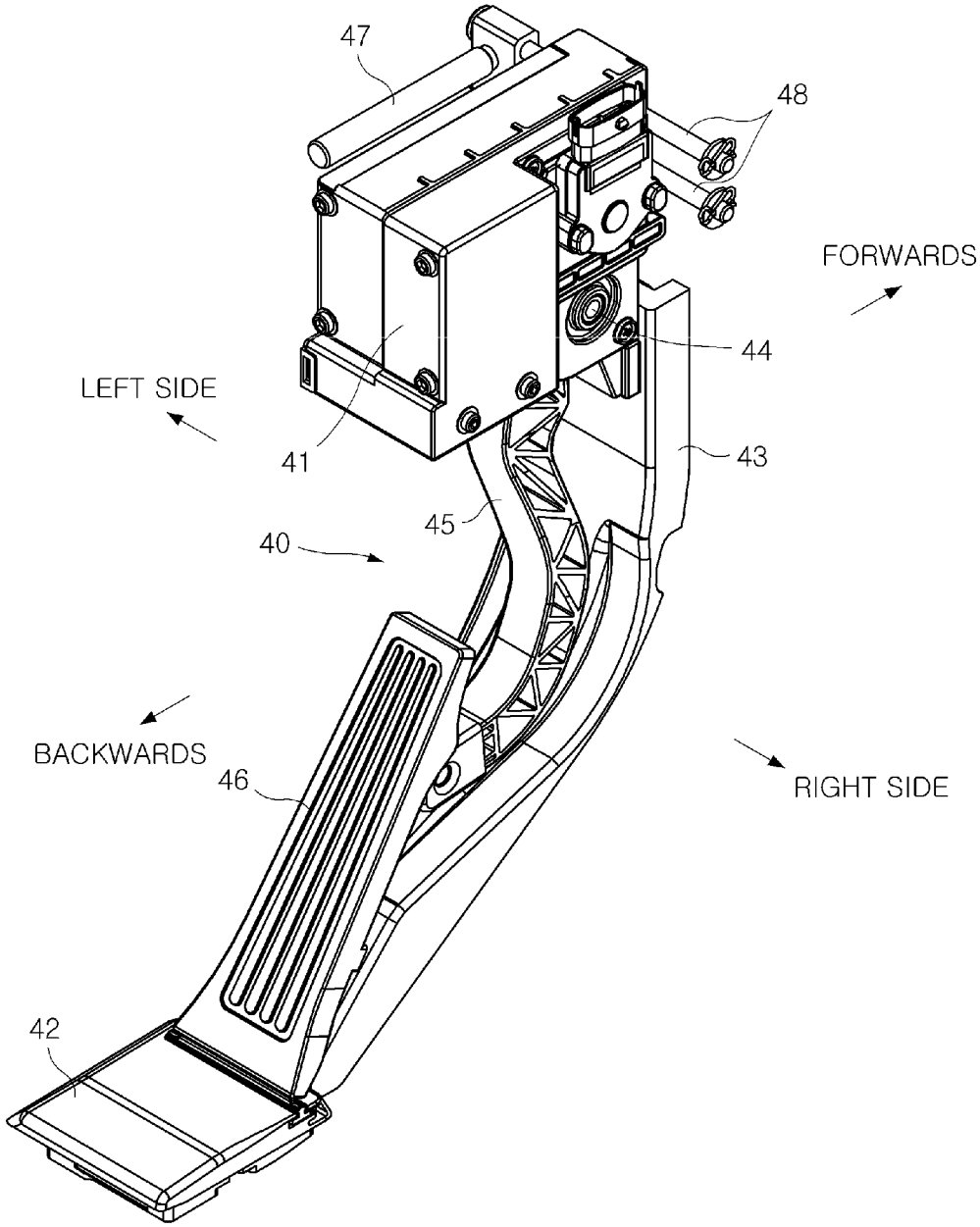
FIG. 7 is a diagram of an exemplary pedal assembly constituting the device according to the present invention.
Figure 8:
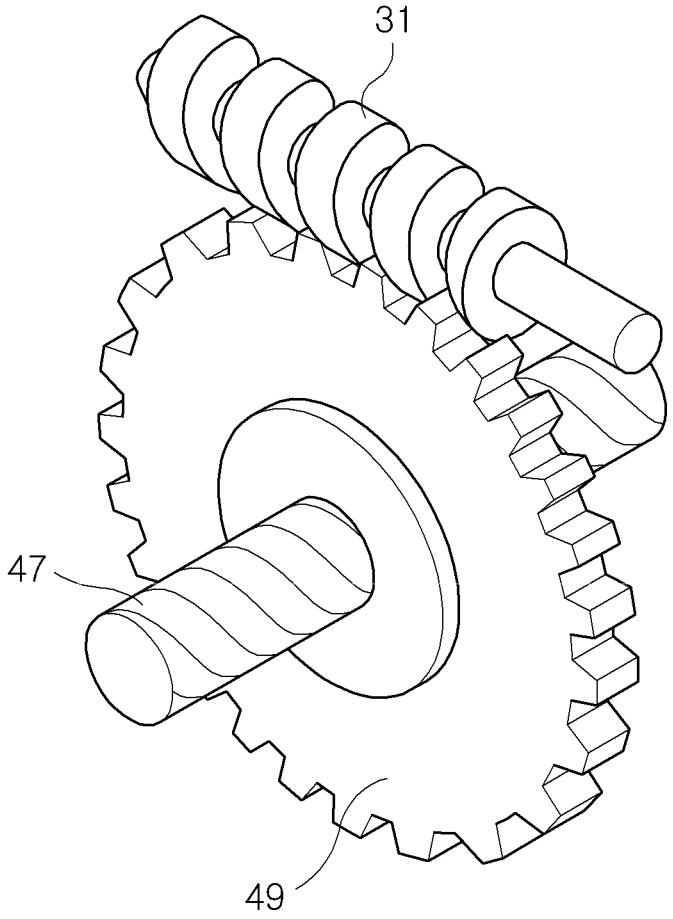
FIG. 8 is a diagram showing an exemplary power transmission configuration of an electric motor and a lead screw in the device according to the present invention.
Figure 9:
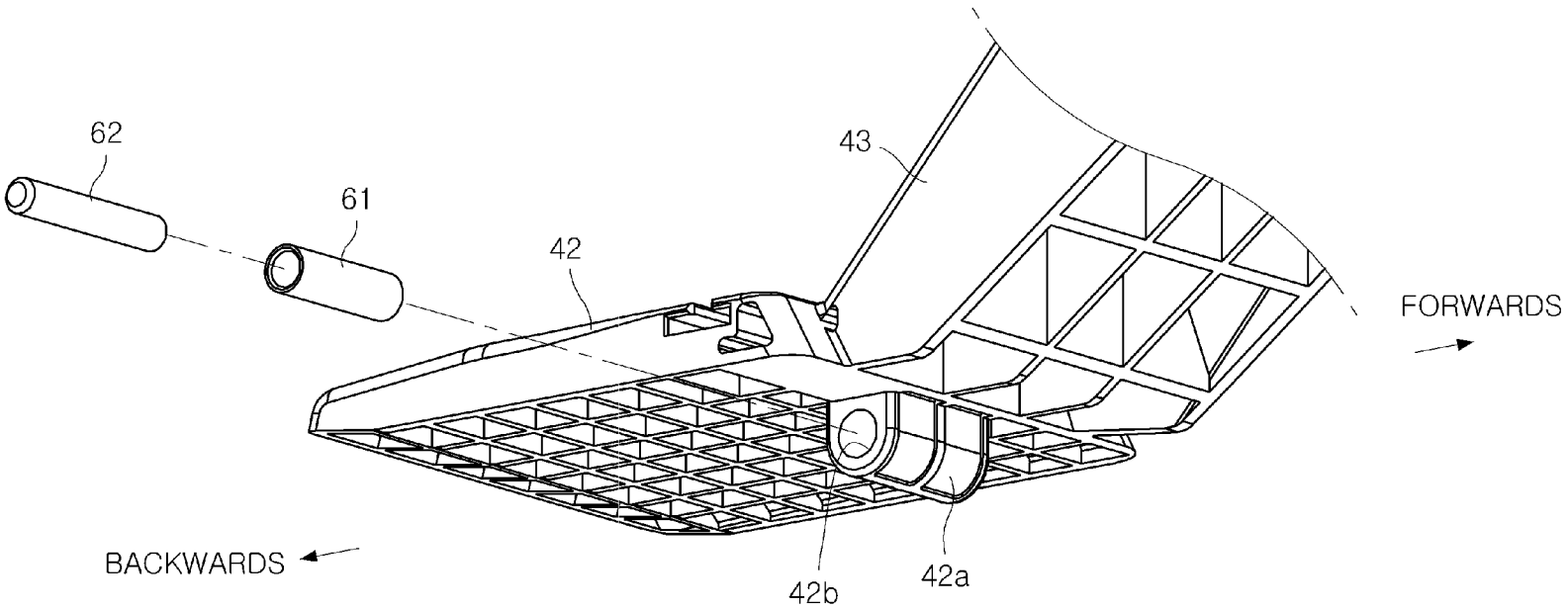
FIG. 9 is an exploded perspective view of an exemplary lower bracket and bracket roller in the device according to the present invention.
Figure 10:
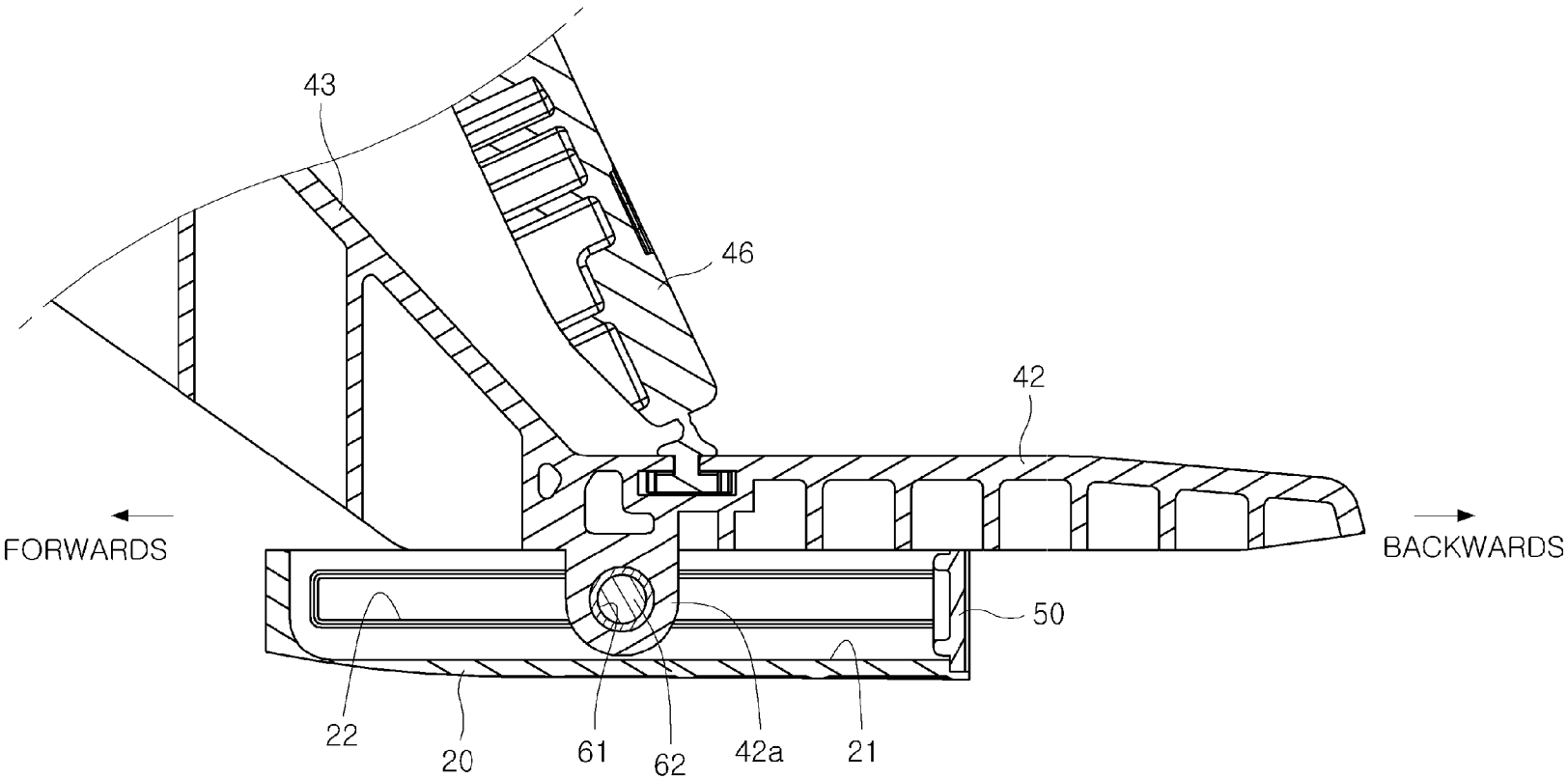
FIGS. 10 and 11 are diagrams showing an exemplary coupling state of the lower bracket and the lower mounting bracket in the device according to the present invention.
Figure 11:
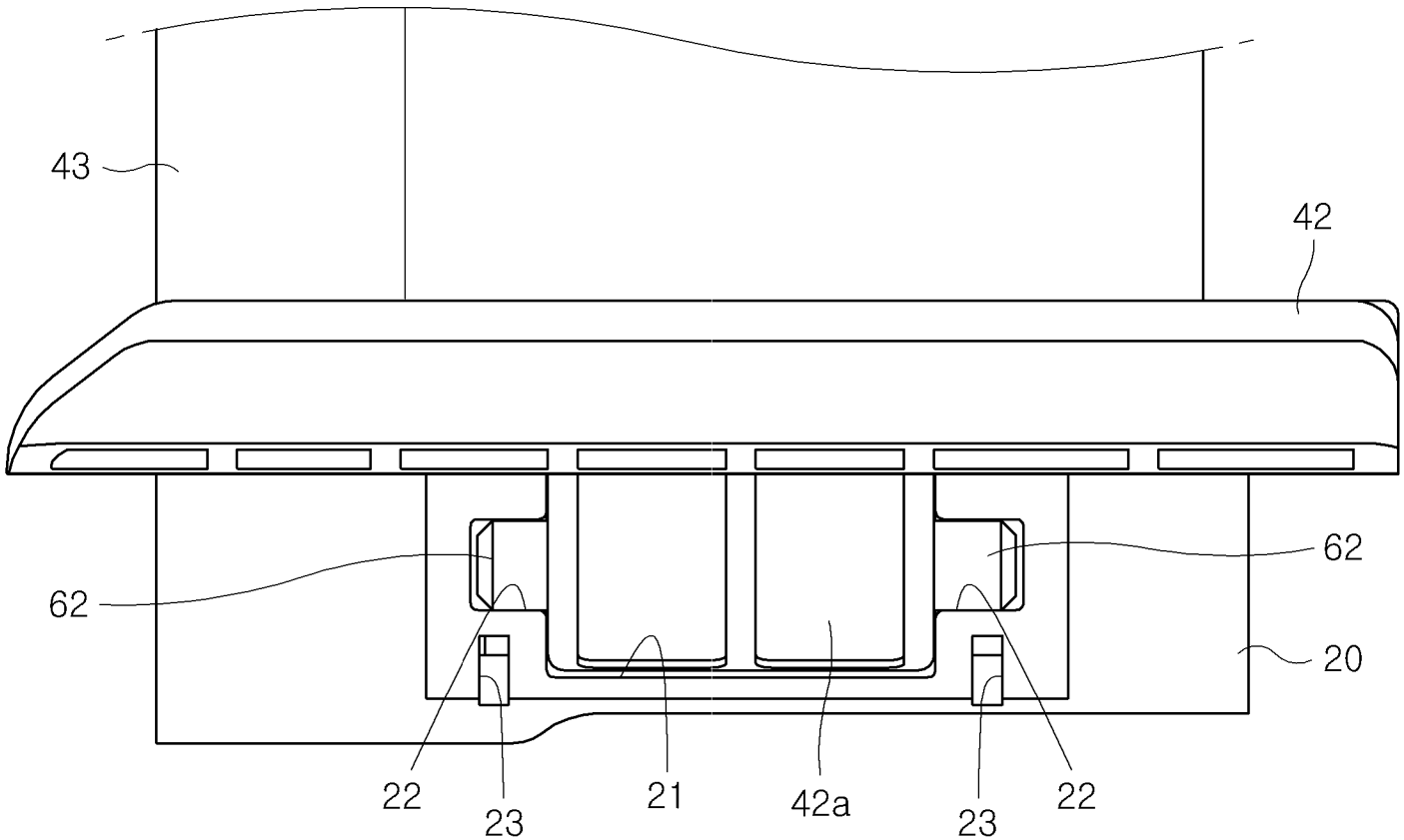

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An adjustable pendant and organ type accelerator pedal device in a vehicle according to various embodiments of the present invention includes a main housing 10 fixedly installed on a dash panel 1 below a driver's seat, a lower mounting bracket 20 fixedly installed on a floor panel 2 below the driver's seat, an electric motor 30 fixedly installed in main housing 10, and a pedal assembly 40 installed in connection with main housing 10 and lower mounting bracket 20 to move forwards and backwards with respect to main housing 10 and lower mounting bracket 20 by motive power of electric motor 30, as shown in FIGS. 2 to 11.

A housing groove 11 opened backwards and guide holes 12 penetrating left and right sides in a form to pass through housing groove 11 and cut in forward and backward directions are integrally formed in main housing 10. One will appreciate that these features may be monolithically formed in the main housing. Two or more guide holes 12 are vertically spaced apart from each other.

A bracket groove 21 with a space opened backwards and upwards and movable along forward and backward directions and a pair of guide grooves 22 that elongate along forward and backward directions on both sides of bracket groove 21 are integrally formed in lower mounting bracket 20. One will appreciate that these features may be monolithically formed in the mounting bracket.

A cover member 50 capable of preventing foreign materials from being invaded into a bracket groove 21 by sealing bracket groove 21 opened backwards is removably coupled to lower mounting bracket 20.

That is, a hook groove 23 is formed on a rear surface where bracket groove 21 is opened in lower mounting bracket 20 and a hook 51 inserted and coupled into hook groove 23 is integrally provided on one surface of cover member 50. One will appreciate that these features may be monolithically formed in the cover member.

Pedal assembly 40 includes a movable housing 41 installed to be able to move forwards and backwards along housing groove 11 while being installed in a form to be inserted in housing groove 11, a supporting bracket 43 having an upper end portion integrally coupled to movable housing 41 and a lower end portion integrally provided with a lower bracket 42 coupled to lower mounting bracket 20 to move in forward and backward directions along bracket groove 21, a pedal arm 45 having an upper end portion rotatably coupled to movable housing 41 with a hinge shaft 44, a pedal pad 46 having an upper end hinge-coupled to the lower end portion of pedal arm 45 and a lower end hinge-coupled to lower bracket 42, a lead screw 47 installed in main housing 10 to move along forward and backward directions by motive power of electric motor 30, and a movable pin 48 installed to be integrally coupled with lead screw 47 by penetrating guide hole 12 and movable housing 41, and installed to move in forward and backward directions through guide hole 12 when lead screw 47 moves. One will appreciate that the supporting bracket may be monolithically formed with the movable housing and the lower bracket.

Movable pin 48 is positioned one by one in each of guide holes 12.

Electric motor 30 and lead screw 47 are installed in a connection structure to transfer motive power with a worm 31 and a worm wheel 49. Worm 31 corresponds to a motor shaft of electric motor 30 and lead screw 47 is coupled with worm wheel 49 by a screw fastening type in a form to penetrate the center of worm wheel 49.

Therefore, when electric motor 30 is driven and worm 31 corresponding to the motor shaft rotates, worm wheel 49 engaged with worm 31 rotates and when worm wheel 40 rotates, lead screw 47 engaged with worm wheel 49 by a gear type moves linearly to protrude on the side surface of worm wheel 49.

A bracket protrusion 42*a* inserted into bracket groove 21 and moving forwards and backwards along bracket groove 21 integrally protrudes on the bottom of lower bracket 42 and a protrusion hole 42*b* penetrating both side surfaces in left and right directions is formed in bracket protrusion 42*a*. One will appreciate that the bracket and protrusion may be monolithically formed.

In addition, a roller bush 61 is installed to penetrate protrusion hole 42*b* and roller bush 61 is installed such that a brocket roller 62 is installed to penetrate roller bush 61, and as a result, both ends of bracket roller 62 penetrating roller bush 61 fit to be inserted into guide grooves 22 formed in lower bracket 20, respectively.

As bracket roller 62 moves along guide groove 22 while rolling, lower bracket 42 moves forwards and backwards with respect to lower mounting bracket 20. In this case, roller bush 61 prevents protrusion hole 42*b* from being damaged due to interference and drastically reduces noise by preventing direct contact between protrusion hole 42*b* and bracket roller 62.

At least one bracket roller 62 is preferably installed and one bracket roller 62 may be installed for each one bracket protrusion 42*a* and alternatively, a plurality of bracket rollers 62 may be installed in one bracket protrusion 42*a*.

Figure 12:
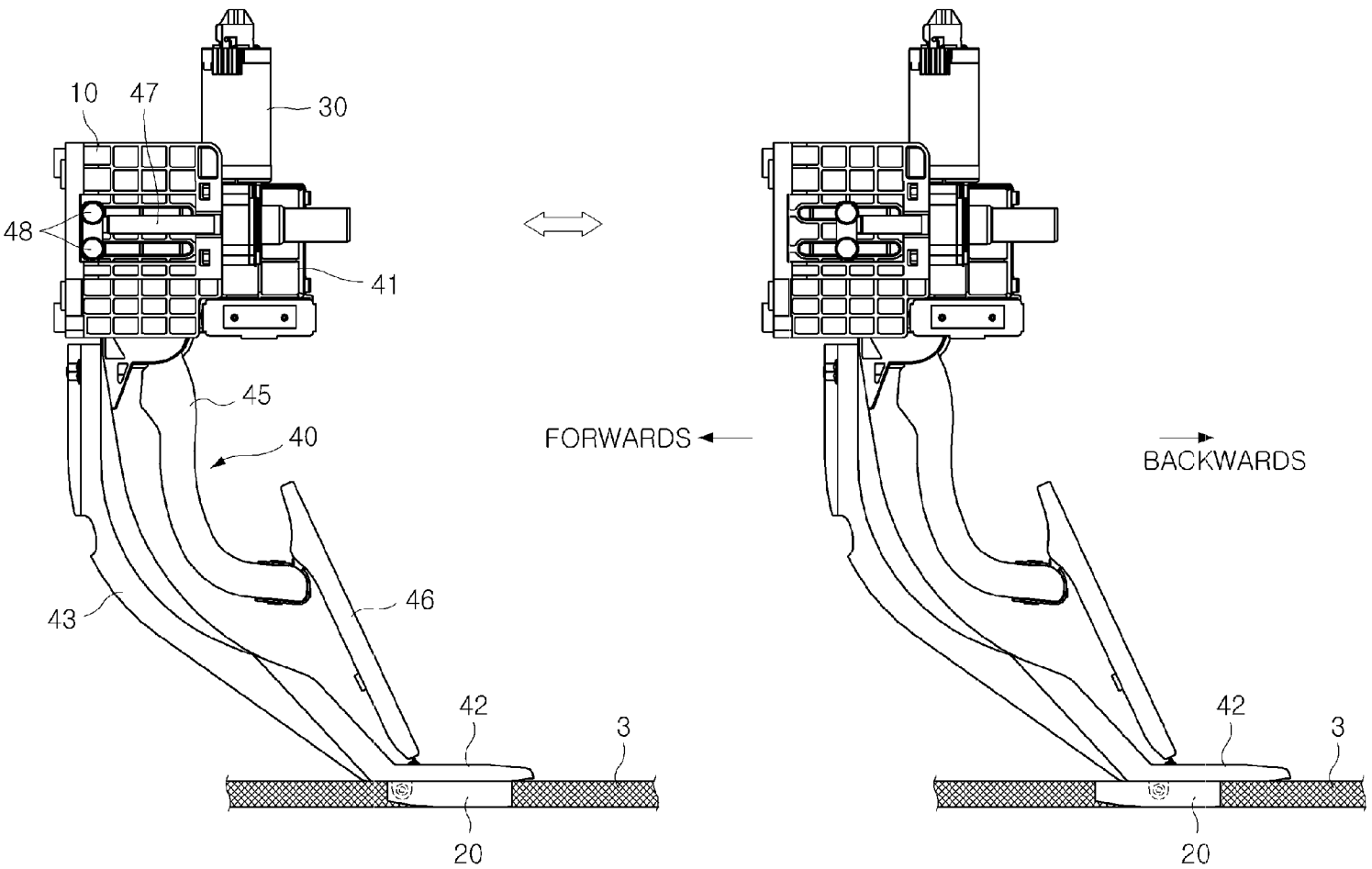
FIG. 12 is a diagram showing an exemplary state before and after the pendant type adjustable organ type accelerator pedal device according to the present invention operates.

In addition, according to various embodiments of the present invention, lower bracket 42 is installed to move in an upper part of a carpet 3 fixed to floor panel 2 at the time of moving backwards as shown in a right figure of FIG. 12, thereby improving a fine view.

Hereinafter, an operation of the present invention will be described.

When power is supplied to electric motor 30 by driver's operating a switch to drive electric motor 30, worm 31 and worm wheel 49 rotate and lead screw 47 protrudes backwards from worm wheel 49 (the case in which the lead screw protrudes backwards is one example and the lead screw may protrude in the forward direction which is an opposite thereto).

When lead screw 47 protrudes backwards, movable pin 48 moves backwards along guide hole 12 and movable housing 41 coupled with movable pin 48 moves to protrude backwards along housing groove 11.

Further, when movable housing 41 moves backwards, supporting bracket 43 and pedal arm 45 that are connected with movable housing 41 and pedal pad 46 and lower bracket 42 have also the power to move backwards.

In this case, bracket protrusion 42*a* of lower bracket 42 moves backwards along bracket groove 21 of lower mounting bracket 20 and at the same time, bracket roller 62 moves backwards while rolling along guide groove 22, and as a result, pedal assembly 40 moves backwards on the whole.

Therefore, the driver may vary the position of pedal pad 46 to an optimal position considering a driver's own body shape, and as a result, the driver can operate pedal pad 46 in a convenient state, thereby greatly improving convenience, and further, reduce a sense of fatigue due to operating pedal pad 46, thereby significantly improving merchantability.

In addition, in the case of forward movement of pedal assembly 40, when worm 31 is driven in a reverse direction by the power of electric motor 30, each of the components moves in an opposite direction thereto, such that pedal assembly 40 moves forwards.

For convenience in explanation and accurate definition in the appended claims, the terms upper or lower, and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An adjustable pendant and organ accelerator pedal device in a vehicle, the device comprising:

a main housing affixed to a dash panel below a driver's seat;

a lower mounting bracket affixed to a floor panel and disposed within a carpet;

a lower bracket slidably coupled to the lower mounting bracket;

an electric motor mounted in the main housing;

a lead screw installed in the main housing to move in linear forward and backward directions by motive power of the electric motor; and a pedal assembly operably coupled to the main housing and the lower bracket to horizontally move forwards and backwards with respect to the main housing and the lower mounting bracket by motive power of the electric motor;

wherein the pedal assembly includes a movable housing which is slidably coupled to the main housing and horizontally movable from the main housing by the motive power of the electric motor; and wherein the lower bracket covers the lower mounting bracket to seal the lower mounting bracket within the carpet;

wherein the main housing includes an integrally formed housing groove that has elongated guide holes extending horizontally forward and backward and penetrating left and right side surfaces parallel to the lead screw;

wherein a bracket groove integrally formed in the lower mounting bracket includes a space opening backwards and upwards accommodating linear forward and backward motion, and a pair of elongated guide grooves extending forward and backward on opposing side surfaces of the bracket groove;

wherein a bracket protrusion inserted into the bracket groove moves forwards and backwards along the bracket groove and integrally protrudes on the bottom of the lower bracket, a protrusion hole penetrating both side surfaces in left and right directions is formed in the bracket protrusion, a bracket roller is installed to penetrate the protrusion hole, and both ends of the bracket roller are inserted into the guide grooves, respectively; and wherein the lower bracket moves parallel to the elongated guide holes, and in the same linear direction as the lead screw.

2. The device as defined in claim 1, wherein a cover member is removably coupled to the lower mounting bracket to seal a backwards facing opening of the bracket groove.

3. The device as defined in claim 1, wherein the pedal assembly includes:

the movable housing installed to move forward and backward along the housing groove while inserted in the housing groove;

a supporting bracket having an upper end portion integrally coupled to the movable housing and a lower end portion integrally provided with the lower bracket coupled to the lower mounting bracket to move in forward and backward directions along the bracket groove;

a pedal arm having an upper end portion rotatably coupled to the movable housing with a hinge shaft interposed therebetween;

a pedal pad having an upper end hinge-coupled to a lower end portion of the pedal arm and a lower end hinge-coupled to the lower bracket; and a movable pin installed to be integrally coupled with the lead screw by penetrating each of the guide holes and the movable housing, and installed to move in forward and backward directions through the guide holes when the lead screw moves.

4. The device as defined in claim 3, wherein at least two guide holes are formed in the main housing vertically spaced apart from each other; and the movable pin is installed in each of the guide holes.

5. The device as defined in claim 3, wherein the electric motor and the lead screw are installed in a connection structure to transfer motive power with a worm and a worm wheel interposed, the worm operably connected to a motor shaft of the electric motor, and the lead screw is coupled with the worm wheel by a screw coupling type in a form to penetrate the center of the worm wheel.

6. The device as defined in claim 3, wherein when the lower bracket moves backwards, the lower bracket is installed to move in an upper part of a carpet fixed to the floor panel.

7. The device as defined in claim 1, wherein a roller bush penetrates the protrusion hole such that the roller bush is positioned between the protrusion hole and the bracket roller, and the bracket roller is installed to penetrate the roller bush.

8. The device as defined in claim 1, wherein at least one bracket roller is installed.

* * * * *